US009698502B2

(12) United States Patent
Tatzel

(10) Patent No.: US 9,698,502 B2
(45) Date of Patent: Jul. 4, 2017

(54) CO-AXIAL INSERTION-TYPE CONNECTION USING A MULTI-PIECE COUPLING NUT

(71) Applicant: ROSENBERGER HOCHFREQUENZTECHNIK GMBH & CO. KG, Fridolfing (DE)

(72) Inventor: Frank Tatzel, Ostermiething (AT)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/762,920

(22) PCT Filed: Jan. 23, 2014

(86) PCT No.: PCT/EP2014/000177

§ 371 (c)(1),
(2) Date: Jul. 23, 2015

(87) PCT Pub. No.: WO2014/114455

PCT Pub. Date: Jul. 31, 2014

(65) Prior Publication Data

US 2015/0357730 A1 Dec. 10, 2015

(30) Foreign Application Priority Data

Jan. 28, 2013 (DE) ..... 20 2013 000 877 U

(51) Int. Cl.
*H01R 9/05* (2006.01)
*H01R 24/40* (2011.01)
(Continued)

(52) U.S. Cl.
CPC ..... *H01R 9/0521* (2013.01); *H01R 13/623* (2013.01); *H01R 13/625* (2013.01); *H01R 24/40* (2013.01); *H01R 2103/00* (2013.01)

(58) Field of Classification Search
CPC ... H01R 9/0521; H01R 13/623; H01R 13/625
(Continued)

(56) References Cited

U.S. PATENT DOCUMENTS 2,076,918 A * 4/1937 Robison ..... F16L 37/248 285/148.13
4,146,288 A * 3/1979 Ramsay ..... H01R 13/625 285/2
(Continued)

FOREIGN PATENT DOCUMENTS

CN 20 1051597 Y 4/2008
CN 10 1752728 A 6/2010
(Continued)

*Primary Examiner* — Amy Cohen Johnson
*Assistant Examiner* — Oscar C Jimenez
(74) *Attorney, Agent, or Firm* — DeLio, Peterson & Curcio. LLC; Robert Curcio

(57) ABSTRACT

A coaxial plug connection having a coaxial plug connector and a counter plug connector. The coaxial plug connector having an inner conductor, an outer conductor which surrounds the inner conductor, and a bayonet nut which is arranged so as to be rotatable relative to the outer conductor and which forms a locking groove for accommodating a projection of a counter plug connector. The locking groove is disposed in the form of a helical groove and the bayonet nut has first and second bayonet nut parts that each form one side of the helical groove, wherein the bayonet nut parts can be displaced relatively to each other in longitudinal axial direction of the coaxial plug connector in order to clamp the projection of the counter plug connector in the helical groove, and wherein the bayonet nut parts can be fixed in position relative to each other by a fixing element.

14 Claims, 4 Drawing Sheets

(51) Int. Cl.
*H01R 13/623* (2006.01)
*H01R 13/625* (2006.01)
*H01R 103/00* (2006.01)

(58) Field of Classification Search
USPC ..... 439/314, 319, 312, 170
See application file for complete search history.

(56) References Cited

U.S. PATENT DOCUMENTS

| | | | | | |
|---|---|---|---|---|---|
| 4,305,180 | A | * | 12/1981 | Schwartz | F16B 21/04 285/396 |
| 4,531,802 | A | | 7/1985 | Tomsa | |
| 4,746,305 | A | * | 5/1988 | Nomura | H01R 13/625 439/319 |
| 5,118,303 | A | * | 6/1992 | LeBaron | H01R 23/27 439/286 |
| 6,602,093 | B1 | | 8/2003 | Cannon | |
| 6,609,925 | B1 | * | 8/2003 | Cannon | H01R 13/625 439/332 |
| 6,808,407 | B1 | | 10/2004 | Cannon | |
| 6,884,099 | B1 | | 4/2005 | Cannon | |

FOREIGN PATENT DOCUMENTS

| | | | |
|---|---|---|---|
| DE | 3042185 | A1 | 5/1981 |
| DE | 103 06 053 | B4 | 11/2003 |
| DE | 10 2004 017803 | B4 | 3/2007 |
| DE | 20 2008 007772 | U1 | 10/2009 |
| DE | 2012008007772 | | 10/2009 |
| EP | 2 187 483 | A2 | 5/2010 |

* cited by examiner

CO-AXIAL INSERTION-TYPE CONNECTION USING A MULTI-PIECE COUPLING NUT

BACKGROUND OF THE INVENTION

1. Field of the Invention

The invention relates to a coaxial insertion-type connector having a coupling nut and to an insertion-type connection comprising a coaxial insertion-type connector and a mating insertion-type connector.

2. Description of Related Art

In the form of what are referred to as BNC connectors, (coaxial) insertion-type connectors of the generic kind are described in IEC 61169-8, MIL-PRF39012, and CECC 22120. They are used in particular for transmitting radio-frequency signals. BNC connectors comprise a center conductor and an outer conductor surrounding the center conductor. The center and outer conductors are separated from one another by means of an insulating body (a dielectric). The electrical connection between two complementary insertion-type connectors is made by means of radial contacts between the center conductors and between the outer conductors. For this purpose, a center conductor and an outer conductor each take the form of slotted shells in which a center conductor and an outer conductor, in pin form, of the other insertion-type connector respectively engage. The elastic expansion and tightening of the slotted shells which go hand in hand with this produce a radial contact-making pressure. The mechanical connection is made by means of a bayonet joint in which, in a press-and-turn movement, two projections on one insertion-type connector are inserted into two L-shaped locking slots in a coupling nut on the other connector and then latch into undercuts at the ends of the locking slots. The axial force required to make the latched connection is usually applied by means of spring members which are compressed as the projections are inserted into the locking slots. To make it possible for manual plugging-together of the insertion-type connection to be easy, it is necessary for the spring constant of the spring members to be designed to be relatively low. However, this low spring constant may cause the problem that the two connectors move relative to one another when even only a low tractive force is exerted on the insertion-type connection, which may result in irregularities in signal transmission.

What is more, due to its principle, the latched position of the bayonet joint is fixed, and this too may have an adverse effect on the transmitting performance of the insertion-type connection. Because of tolerances on the dimensions of the insertion-type connectors, the axial air-gaps between the center conductors and between the outer conductors are relatively undefined, which may have an adverse effect on the repeatability of the transmitting performance.

To avoid the disadvantages of classic BNC insertion-type connections, what are referred to as precision BNC connections have been developed (see for example DE 103 06 053 B4 and DE 10 2004 017 803 B4). Instead of a slotted outer-conductor contact-making shell, these have a solid, tubular, outer-conductor contact-making shell with which contact is made at the end-face. The outer-conductor plug of the mating insertion-type connector has a shoulder extending round in a loop on its inside. Provision is also made for the replacement of the solid dielectric used in classic BNC insertion-type connectors by a precision support. These two provisions are able to produce a considerably improved transmitting performance. To enable a sufficiently high axial contact-making pressure to be achieved and to enable this to be maintained even when a tensile force is applied to the insertion-type connection, provision is made for the insertion-type connectors to be pressed against one another axially by the tightening of a ring nut connected to the coupling nut.

Precision BNC connectors have the disadvantage that they are not compatible with classic BNC connectors.

SUMMARY OF THE INVENTION

Taking the above as a point of departure, the object underlying the invention was to specify an improved coaxial insertion-type connector. This was, in particular, to be compatible both with classic BNC sockets and with the known precision BNC sockets and at the same time was to make good transmitting performance possible, was able to be coupled with no play and/or was to prevent any unintended change in position relative to its mating insertion-type connector.

This object is achieved by a coaxial insertion-type connector as defined in the claims. A coaxial insertion-type connection comprising a coaxial insertion-type connector of this kind forms the subject matter of ancillary claims. Advantageous embodiments of insertion-type connector according to the invention form the subject matter of the respective sets of dependent claims and can be seen from the following description of the invention.

The above and other objects, which will be apparent to those skilled in the art, are achieved in the present invention which is directed to a coaxial insertion-type connector comprising a center conductor, an outer conductor surrounding the center conductor, and a coupling nut which is arranged to be rotatable relative to the outer conductor and which forms a locking slot to receive a projection on a mating insertion-type connector, wherein the locking slot takes the form of a helical slot and the coupling nut has a first part and a second part which form respective side-walls of the helical slot, the parts of the coupling nut being displaceable relative to one another in the direction defined by the longitudinal axis of the coaxial insertion-type connector to clamp the projection on the mating insertion-type connector in the helical slot, and the parts of the coupling nut being able to be fixed in position relative to one another by a fixing member.

The outer conductor preferably includes longitudinal slotting.

The side-walls may be formed by the first and second parts of the coupling nut are of different helix angles. The first and second parts of the coupling nut may be, and preferably are, solid in rotation with one another.

An axial guide may be formed between the first and second parts of the coupling nut.

The first part of the coupling nut is preferably immovable in the direction defined by the longitudinal axis as the projection is clamped and the second part of the coupling nut is preferably movable relative to the first part of the coupling nut in the direction defined by the longitudinal axis by a ring nut, with an inside thread in the ring nut engaging in an outside thread on the outer conductor or on a housing surrounding the outer conductor.

The first part of the coupling nut may be fixed to the outer conductor or the housing by a latching connection immovable in the direction defined by the longitudinal axis.

The second part of the coupling nut may be immovable in the direction defined by the longitudinal axis as the projection is clamped and the first part of the coupling nut is displaceable relative to the second part of the coupling nut in the direction defined by the longitudinal axis by a ring nut, with an inside thread in the ring nut engaging in an outside thread on the first part of the coupling nut.

The coupling nut's second part and/or the ring nut may be supported against a projection on the outer conductor or on the housing.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 4:
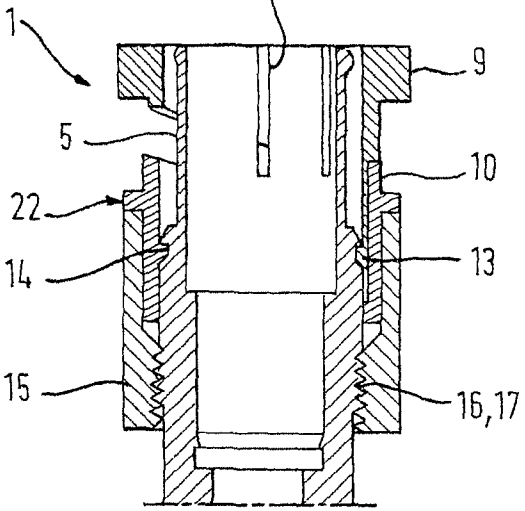
FIG. 4 is a longitudinal section through the coaxial insertion-type connector according to the invention of the coaxial insertion-type connection shown in FIG. 1.
Figure 2:
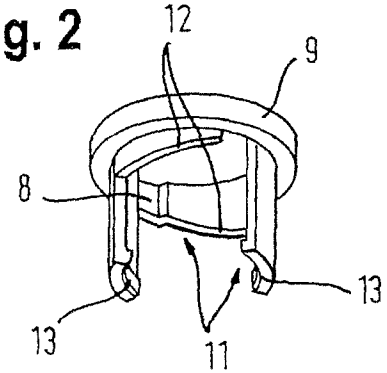
FIG. 2 is a perspective view of a first part of the coupling nut of the coaxial insertion-type connector shown in FIG. 1.
Figure 3:
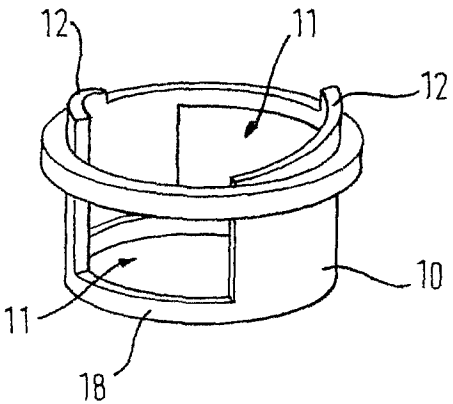
FIG. 3 is a perspective view of a second part of the coupling nut of the coaxial insertion-type connector shown in FIG. 1.
Figure 1:
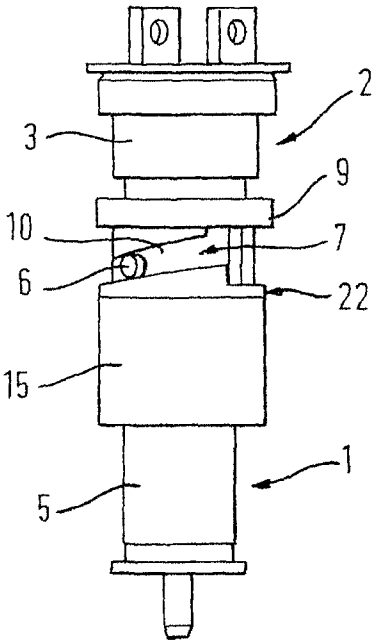
FIG. 1 is a perspective view of a first embodiment of coaxial insertion-type connection according to the invention.

In describing the preferred embodiment of the present invention, reference will be made herein to FIGS. 1-13 of the drawings in which like numerals refer to like features of the invention.

The idea underlying the invention is to separate the electrical contact-making region from the mechanical contact-making region in a coaxial insertion-type connection of the generic kind, these two regions thus being able to be moved or set relative to one another. It was recognized to be advantageous to assume the electrical contact-making region, which may indeed even be governed by standards, to be fixed and to assume the mechanical contact-making region to be displaceable axially, i.e., in the direction of insertion, instead. Building on this, it was recognized that, when the arrangement for locking by a bayonet joint has to be brought to a fixed, preset, final position, there is no sense in any axial displacement of the contact-making region. A further conclusion of the reflections was that a pre-loaded spring member is not a suitable means when it is a question of generating an axial contact-making pressure sufficiently high to hold the coaxial insertion-type connectors securely in position relative to one another.

This basic idea underlying the invention was put into practice in a coaxial insertion-type connector (in particular for radio-frequency applications) which has (at least) one center conductor, (at least) one outer conductor surrounding the center conductor (and electrically insulated therefrom), and (at least) one coupling nut which is arranged to be rotatable relative to (at least) the outer conductor, the coupling nut forming at least one locking slot (and preferably two or more) to receive at least one projection (and preferably two or more) on a mating insertion-type connector. In accordance with the invention, the locking slot takes the form of a helical slot and the coupling nut has a first part and a second part which form respective side-walls of the helical slot, the parts of the coupling nut being displaceable relative to one another in the longitudinal direction of the coaxial insertion-type connector (which corresponds to the direction of plugging together of a coaxial insertion-type connection made by means of this coaxial insertion-type connector) to clamp the projection on the mating insertion-type connector in the helical slot. Also provided is (at least) one fixing member by which the parts of the coupling nut can be fixed in position, so that the clamping of the projection on the mating insertion-type connector can be maintained in the long term. The fixing member is also preferably used to displace the parts of the coupling nut relative to one another.

What is meant by "clamping" for the purposes of the invention is that the side-walls of the helical slot rest against the projection. Freedom from play can largely be achieved simply by this means. The freedom from play can be improved if the side-walls rest against the projection under pressure.

A coaxial insertion-type connection according to the invention comprises at least one coaxial insertion-type connector according to the invention and a mating insertion-type connector complementary thereto.

By virtue of the design according to the invention of the coaxial insertion-type connector, the projection on the mating insertion-type connector can be held fixed at any desired point in the helical slot and the two insertion-type connectors can thus be held fixed in a variable connected position on their longitudinal axis. This is achieved on the one hand by making the locking slots of a helical form, i.e., by putting them at a helix angle relative to the longitudinal axis of the coaxial insertion-type connector or the coaxial insertion-type connection, whereby a rotation of the coupling nut entails a relative movement of the two coaxial insertion-type connectors on the longitudinal axis as the bayonet jointis locked. The relative movement of the insertion-type connectors, or in other words an axial contact-making pressure created between them, can thus be set by an adjusted rotation of the coupling nut. Due to the multi-piece nature of the coupling nut and in conjunction with the fixing member, the coaxial insertion-type connectors can then be held fixed in the connected position which has been set. A play-free connection can thus be obtained between the coaxial insertion-type connector according to the invention and any desired mating BNC insertion-type connectors even when the latter, as is the case with classic BNC insertion-type connectors, rely on radial contact between their outer conductors rather than (as is the case with known precision insertion-type connectors) on axial contact between said outer conductors.

To produce resiliently-loaded radial contact between the outer conductors when a coaxial insertion-type connector according to the invention is connected to a classic BNC mating insertion-type connector, provision may be made for the outer conductor of the coaxial insertion-type connector according to the invention to have at least one, and preferably a plurality of, longitudinal slots, whereby appropriate resilient, contact-making tongues are formed. In spite of these longitudinal slots, the coaxial insertion-type connector according to the invention is also suitable for making axial contact (at the end-face) with a mating precision BNC insertion-type connector, because the two insertion-type connectors can always be connected by means of the coupling nut, regardless of any tolerances, with a suitable axial contact-making pressure which is sufficiently high to ensure good transmitting performance, but at the same time any damage to the resilient contact-making tongues due to non-allowable compressive stresses on the longitudinal axis is ruled out.

The side-walls of the helical slot preferably extend in a stepless form, thus making it possible for the projection on the mating insertion-type connector to be clamped at any desired point in the helical slot and the two insertion-type connectors in the insertion-type connection according to the invention thus to be connected in any desired relative position.

In a preferred embodiment of coaxial insertion-type connector according to the invention, provision may be made for the side-walls formed by the parts of the coupling nut to be of different helix angles. What can thereby be achieved is positively inter-engaged fixing of the projection or projections on the mating insertion-type connector in the helical slot or slots because any movement of the projections forward and/or back is prevented by a decreasing width of the helical slot. In the preferred embodiment having at least two helical slots which each receive at least one projection on the mating insertion-type connector, provision may then be made, as a particular preference, for the different helix angles of the side-walls of the helical slots to be selected in such a way that the width of at least one helical slot decreases in one direction of rotation and the width of another/the other helical slot decreases in the other direction of rotation, whereby the projections are prevented from moving either backward or forward in the helical slots.

As well as for this preferred type of positively inter-engaged fixing of the projection in the helical slot, provision may also be made for it to be fixed purely by friction. As a further alternative, the possibility may also exist of the side-walls being made of a stepped form, whereby defined fixed positions can be created for the projection in which it can be fixed by positive inter-engagement.

Provision may preferably be made for the parts of the coupling nut of the coaxial insertion-type connector according to the invention to be arranged to be solid in rotation with one another, whereby handling in the locking process can, in particular, be simplified. The arranging of the parts of the coupling nut to be solid in rotation may preferably be achieved by an axial guide formed between them.

In an advantageous embodiment of coaxial insertion-type connector according to the invention, provision may, furthermore, be made for the first part of the coupling nut to be axially immovable as the projection is clamped and for the second part of the coupling nut to be displaceable relative to the first part of the coupling nut in the direction defined by the longitudinal axis by means of a ring nut, with an inside thread in the ring nut engaging in an outside thread on the outer conductor or on a housing surrounding the outer conductor. Provision may in particular be made in this case for the first part of the coupling nut to be fixed to the outer conductor or the housing by means of a latching connection in such a way as to be axially immovable.

In an embodiment of coaxial insertion-type connector according to the invention which is likewise preferred, provision may be made for the second part of the coupling nut to be axially immovable as the projection is clamped and for the first part of the coupling nut to be displaceable relative to the second part of the coupling nut in the axial direction by means of a ring nut, with an inside thread in the ring nut engaging in an outside thread on the first part of the coupling nut. The axially immovable position of the second part of the coupling nut as the clamping takes place (i.e., as a force is applied by the tightening of the ring nut and forces of reaction are generated at the same time) can be achieved by having the coupling nut's second part and/or the ring nut supported against a projection on the outer conductor of the coaxial insertion-type connector according to the invention or on the housing thereof.

A first embodiment of coaxial insertion-type connection according to the invention is shown in FIGS. 1 to 7. It comprises a coaxial insertion-type connector 1 according to the invention in the form of a male connector and a mating insertion-type connector 2 complementary thereto, i.e., in the form of a coupler. The mating insertion-type connector 2 takes the form of a precision coupler and has, on the inside of its outer conductor 3, a shoulder 4 extending round in a loop with which the end-face of an outer conductor 5 of the coaxial insertion-type connector 1, which outer conductor is provided with one or more longitudinal slots 21, is intended to make contact.

Both the coaxial insertion-type connector 1 and the mating insertion-type connector 2 each comprise, in a known way, a center conductor and also an insulating body (a dielectric) made of electrically insulating material by which the center conductor is held in the given outer conductor and is electrically insulated therefrom. For greater clarity, the center conductor and the insulating body have not been shown in the drawings.

The mechanical connection between the two insertion-type connectors is made by a bayonet joint. For this purpose, the coaxial insertion-type connector 1 comprises a coupling nut and the mating insertion-type connector 2 comprises two projections 6 on the outside of its outer conductor 3. The coupling nut creates two helical slots 7 which extend both in the circumferential direction and in the direction defined by the longitudinal axis of the insertion-type connection. Via respective longitudinal grooves 8, the projections 6 on the mating insertion-type connector 2 can be introduced into the helical slots 7 as a result of the insertion-type connectors being moved towards one another in the direction defined by their longitudinal axes. By turning the coupling nut, the projections 6 can then be moved on towards the closed ends of the helical slots 7. Due to the helical path followed by the helical slots 7, this entails a relative movement of the two insertion-type connectors in their longitudinal directions.

In contrast to what happens in known bayonet joints of BNC insertion-type connectors, the projections do not latch into lateral recesses in locking slots. Instead, in the coaxial insertion-type connection according to the invention, the projections can be held fixed at any desired point in the helical slots 7 by decreasing the width of the helical slots 7 and thus clamping the projections 6 in them.

For this purpose, the coupling nut comprises two parts 9, 10, namely a first part 9 which is arranged at the insertion end of the coaxial insertion-type connector 1 and a second part 10. The two parts 9, 10 of the coupling nut are arranged to be movable relative to one another axially, i.e., in the longitudinal direction of the coaxial insertion-type connection, but to be solid in rotation with one another. This is achieved by causing the two parts 9, 10 of the coupling nut to form axially extending cut-outs 11, in which complementary portions of whichever is the other part of the coupling nut in the given case, 9 or 10, engage.

Each of the parts 9, 10 of the coupling nut has two end-faces extending in a helix which form respective side-walls 12 of the two helical slots 7. Provision is made in this case for the helix angle of the side-walls 12 formed by the first part 9 of the coupling nut to be different from the helix angle of the side-walls 12 formed by the second part 10 of the coupling nut. Because the two parts 9, 10 of the coupling nut are movable relative to one another axially, the result is that the widths of the helical slots 7 are variable. The different helix angles of the side-walls 12 produce for this purpose an increasing or decreasing slot width along the path followed by the two helical slots 7.

On each of the portions which engage in the cut-outs in the second part 10 of the coupling nut, the first part 9 of the coupling nut forms a latching projection 13 which engages in a surrounding depression 14 in the outer conductor 5 of the coaxial insertion-type connector 1 and which thereby fixes the first part 9 of the coupling nut to be immovable in the longitudinal direction on the outer conductor 5 but rotatable thereon. The second part 10 of the coupling nut is mounted to be freely movable on a portion of the outer conductor 5. It is thus arranged both to be, within limits, both in the directions defined by the longitudinal axis of the insertion-type connection and, together with the first part 9 of the coupling nut, rotatable on the outer conductor 5. Using a ring nut 15, the second part 10 of the coupling nut can be displaced along the longitudinal axis towards the first part 9 of the coupling nut. For this purpose, the ring nut 15 has, on a portion of its interior, an inside thread 16 which engages in an outside thread 17 on the outer conductor 5. A portion of the ring nut 15 which follows on from the inside thread 16 fits round part of the second part 10 of the coupling nut and is supported there against at its end-face. The second part of the coupling nut has for this purpose a surrounding projection 22 on its outside.

Figure 5:
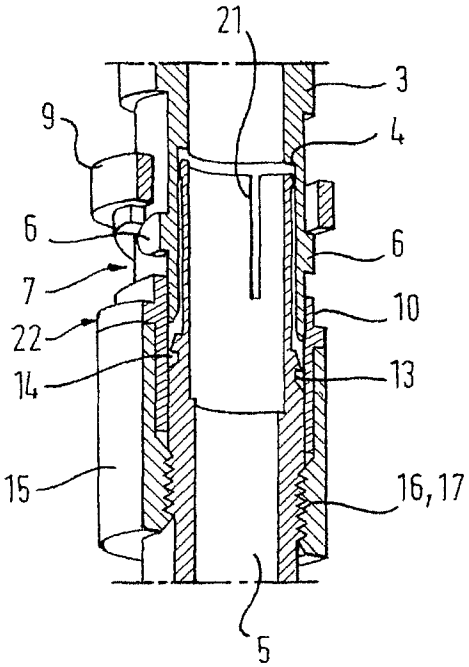
FIG. 5 is a longitudinal section through the insertion-type connectors of the coaxial insertion-type connection shown in FIG. 1 when in a first relative position.
Figure 11:
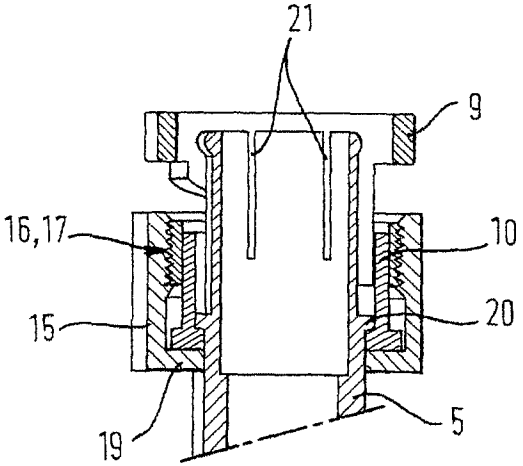
FIG. 11 is a longitudinal section through the coaxial insertion-type connector according to the invention of the coaxial insertion-type connection shown in FIG. 8.
Figure 9:
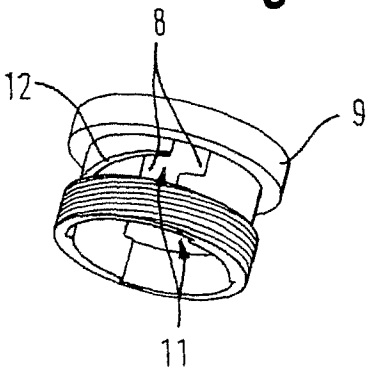
FIG. 9 is a perspective view of a first part of the coupling nut of the coaxial insertion-type connection shown in FIG. 8.
Figure 10:
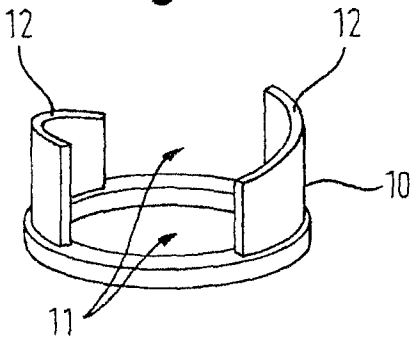
FIG. 10 is a perspective view of a second part of the coupling nut of the coaxial insertion-type connection shown in FIG. 8.
Figure 8:
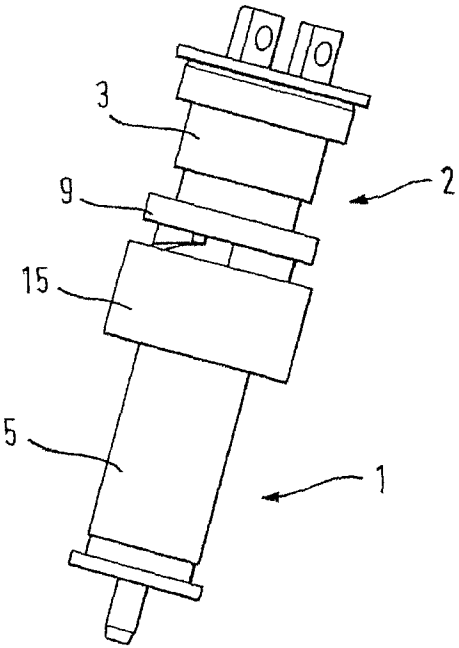
FIG. 8 is a perspective view of a second embodiment of coaxial insertion-type connection according to the invention.

To allow the insertion-type connectors to make electrical and mechanical contact, they are first plugged together axially until the projections 6 on the mating insertion-type connector 2 have arrived in the helical slots 7 in the coupling nut of the coaxial insertion-type connector 1 (see FIG. 5). When this takes place, provision is made, by means of a suitable position for the ring nut, for the width of the helical slots 7 to be larger by an adequate amount than the diameter of the projections 7 of circular cross-section.

By turning the ring nut 15 (in the clockwise direction), the projections 6 can then be moved towards the closed ends of the helical slots 7. This entails further relative movement of the two insertion-type connectors along the longitudinal axis. The ring nut 15 is turned until the outer conductor 5 of the coaxial insertion-type connector 1 abuts at its end-face against the shoulder 4 on the inside of the outer conductor 3 of the mating insertion-type connector 2 (see FIG. 6). When this takes place, because of a portion 18 which is formed to extend round and close the loop, the second part 10 of the coupling nut prevents the portions of the first part 9 of the coupling nut which form the latching projections 13 from being bent apart and thus prevents the coupling nut from detaching from the outer conductor 5 of the coaxial insertion-type connector 1.

If it is not a precision coupler which is being used as a mating insertion-type connector, the coupling nut is turned until a connection of a desired size is obtained for the outer conductor, which then makes only radial contact.

Once the end position is reached, i.e., once the two insertion-type connectors have been fully plugged together, said end position is fixed by turning the ring nut 15 (in the clockwise direction). Because the outer conductors 3, 5 of the two insertion-type connectors are in contact at their end-faces, the coupling nut does not have to be secured against being turned as well when the turning takes place.

When however it is not a precision coupler which is being used as a mating insertion-type connector, it may be necessary for the coupling nut to be secured against being turned in an unwanted way with the ring nut 15 when the latter is tightened.

Figure 7:
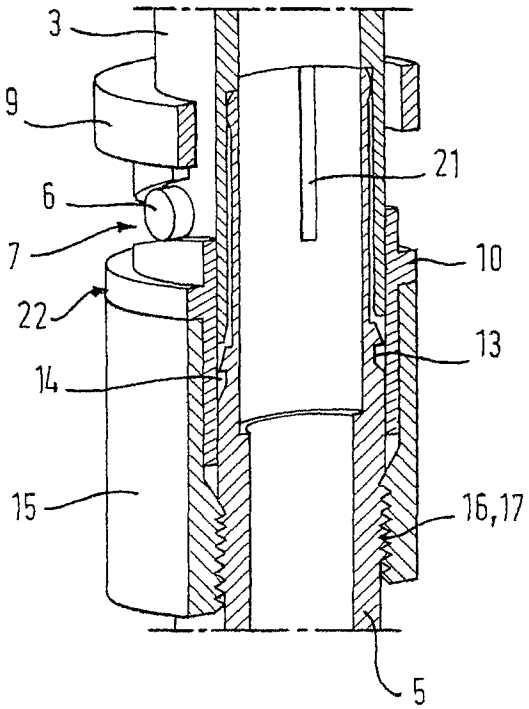
FIG. 7 is a longitudinal section through the insertion-type connectors of the coaxial insertion-type connection shown in FIG. 1 when in a third relative position.
Figure 6:
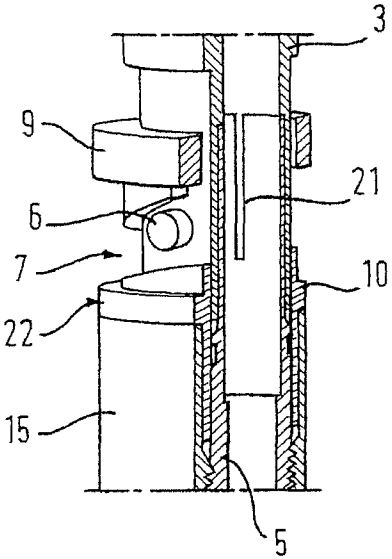
FIG. 6 is a longitudinal section through the insertion-type connectors of the coaxial insertion-type connection shown in FIG. 1 when in a second relative position.

By the turning of the ring nut 15, the second part 10 of the coupling nut is moved towards the first part 9 of the coupling nut until the projections 6 are clamped between the side-walls 12 of the helical slots 7 (see FIG. 7). It is then no longer possible for the bayonet joint to be released unless the ring nut 15 is screwed back, because the widths of the helical slots 7 decrease, due to the different helix angles of the side walls 12 which are formed by the first part 9 of the coupling nut on the one hand and the second part 10 of the coupling nut on the other hand, these widths of the two helical slots 7 decreasing, in addition, in different directions of rotation.

The second embodiment of insertion-type connection according to the invention which is shown in FIGS. 8 to 13 differs from the first embodiment shown in FIGS. 1 to 7 in the forms taken by the coupling nut and the ring nut 15 and in the interaction between these and the outer conductor 5 of the coaxial insertion-type connector 1.

In this embodiment, the first part 9 of the coupling nut is not fastened directly to the outer conductor 5 of the coaxial insertion-type connector 1. Instead, an outside thread 17 on an annular portion thereof adjacent the second part 10 of the coupling nut engages in an inside thread 16 in the ring nut 15. The second part 10 of the coupling nut is situated inside the ring nut 15, being supported on the one hand on a collar 19 of the ring nut 15 and on the other hand against a surrounding projection 20 on the outer conductor 5.

In this embodiment the two parts 9, 10 of the coupling nut also form an axial guide, in that there are provided in either of the two parts 9, 10 of the coupling nut axially extending cut-outs in which complementary portions of whichever is the other part of the coupling nut in the given case, 9 or 10, engage.

Figure 13:
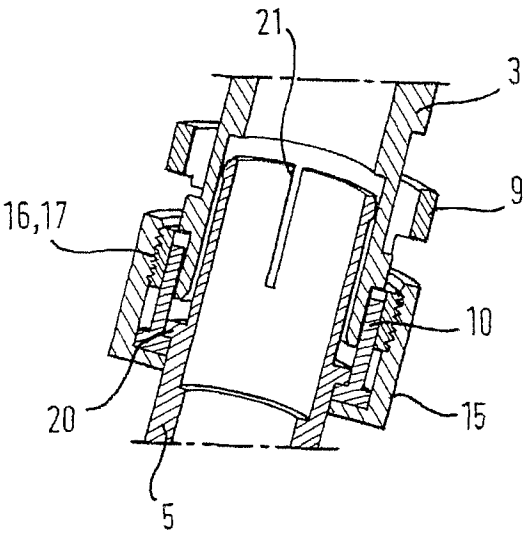
FIG. 13 is a longitudinal section through the insertion-type connectors of the coaxial insertion-type connection shown in FIG. 1 when in a second relative position.
Figure 12:
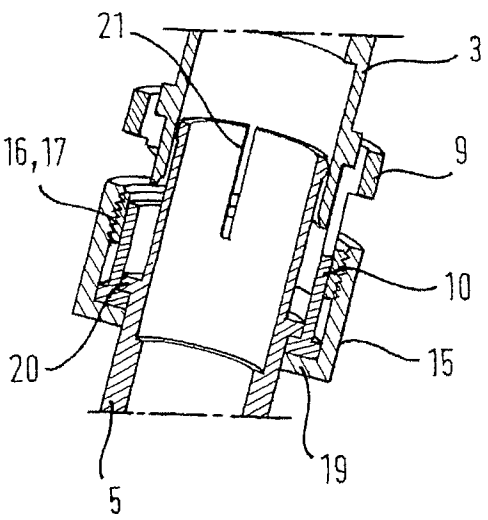
FIG. 12 is a longitudinal section through the insertion-type connectors of the coaxial insertion-type connection shown in FIG. 8 when in a first relative position.

To allow the two insertion-type connectors to make electrical and mechanical contact, they are plugged together axially, the projections 7 on the mating insertion-type connector 2 being guided in longitudinal grooves 8 in the first part of the coupling nut until they reach the helical slots 7 created by the two parts 9, 10 of the coupling nut (see FIGS. 12 and 13). The ring nut 15 is then turned (in the clockwise direction). When this is done, the coupling nut is turned with it because the friction in the paired threads between the ring nut 15 and the first part 9 of the coupling nut and the friction between the ring nut 15 and the second part 10 of the coupling nut exceed the friction between the helical slot 12 in the first part 9 of the coupling nut and the projections 7 on the mating insertion-type connector 2. This concomitant turning of the coupling nut takes place until such time as the two outer conductors 3, 5 make contact at their end-faces and thus prevent any further concomitant turning. The relative rotation between the ring nut 15 and the first part 9 of the coupling nut, which then begins, results in the first part 9 of the coupling nut being moved along the longitudinal axis towards the second part 10 of the coupling nut. In the course of this, the second part 10 of the coupling nut is held immobile along the longitudinal axis between the collar 19 of the ring nut 15 and the surrounding projection 20 on the outer conductor 5. This relative movement along the longitudinal axis between the two parts 9, 10 of the coupling nut is thus responsible for the clamping of the projections 7 on the mating insertion-type connector 2 in the helical slots 7 in the coupling nut.

In this embodiment, provision is also made for the side-walls 12 forming the helical slots 7 to be of different helix angles, whereby any turning of the coupling nut in either direction of rotation is prevented once the ring nut 15 has been tightened.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A coaxial insertion-type connector comprising a center conductor, an outer conductor surrounding the center conductor, and a coupling nut which is arranged to be rotatable relative to the outer conductor and which forms a locking slot to receive a projection on a mating insertion-type connector, wherein the locking slot takes the form of a helical slot and the coupling nut has a first part and a second part which form respective side-walls of the helical slot, wherein the side-walls formed by the first and second parts of the coupling nut are of different helix angles, the parts of the coupling nut being displaceable relative to one another in the direction defined by the longitudinal axis of the coaxial insertion-type connector to clamp the projection on the mating insertion-type connector in the helical slot, and the parts of the coupling nut being able to be fixed in position relative to one another by a fixing member.

2. The coaxial insertion-type connector of claim 1, wherein the first and second parts of the coupling nut are solid in rotation with one another.

3. The coaxial insertion-type connector of claim 2, including an axial guide formed between the first and second parts of the coupling nut.

4. The coaxial insertion-type connector of claim 3, wherein the first part of the coupling nut is immovable in the direction defined by the longitudinal axis as the projection is clamped and the second part of the coupling nut is movable relative to the first part of the coupling nut in the direction defined by the longitudinal axis by a ring nut, with an inside thread in the ring nut engaging in an outside thread on the outer conductor or on a housing surrounding the outer conductor.

5. The coaxial insertion-type connector of claim 4, wherein the first part of the coupling nut is fixed to the outer conductor or the housing by a latching connection immovable in the direction defined by the longitudinal axis.

6. The coaxial insertion-type connector of claim 3, wherein the second part of the coupling nut is immovable in the direction defined by the longitudinal axis as the projection is clamped and the first part of the coupling nut is displaceable relative to the second part of the coupling nut in the direction defined by the longitudinal axis by a ring nut, with an inside thread in the ring nut engaging in an outside thread on the first part of the coupling nut.

7. The coaxial insertion-type connector of claim 6, wherein the coupling nut's second part and/or the ring nut is supported against a projection on the outer conductor or on the housing.

8. The coaxial insertion-type connector of claim 1, wherein the first part of the coupling nut is immovable in the direction defined by the longitudinal axis as the projection is clamped and the second part of the coupling nut is movable relative to the first part of the coupling nut in the direction defined by the longitudinal axis by a ring nut, with an inside thread in the ring nut engaging in an outside thread on the outer conductor or on a housing surrounding the outer conductor.

9. The coaxial insertion-type connector of claim 8, wherein the first part of the coupling nut is fixed to the outer conductor or the housing by a latching connection immovable in the direction defined by the longitudinal axis.

10. The coaxial insertion-type connector of claim 1, wherein the second part of the coupling nut is immovable in the direction defined by the longitudinal axis as the projection is clamped and the first part of the coupling nut is displaceable relative to the second part of the coupling nut in the direction defined by the longitudinal axis by a ring nut, with an inside thread in the ring nut engaging in an outside thread on the first part of the coupling nut.

11. The coaxial insertion-type connector of claim 10, wherein the coupling nut's second part and/or the ring nut is supported against a projection on the outer conductor or on the housing.

12. The coaxial insertion-type connector (1) of claim 1, wherein the outer conductor includes longitudinal slotting.

13. The coaxial insertion-type connection of claim 1 including a mating insertion-type connector.

14. The coaxial insertion-type connector of claim 1, wherein the first and second parts of the coupling nut are solid in rotation with one another.

* * * * *